United States Patent [19]

Patton

[11] Patent Number: 4,626,061

[45] Date of Patent: Dec. 2, 1986

[54] CRIMP CONNECT TERMINALS

[75] Inventor: Roy A. Patton, Visalia, Calif.

[73] Assignees: Ronald A. Patton; Dennis D. Patton, both of Fort Wayne, Ind.

[21] Appl. No.: 792,813

[22] Filed: Oct. 30, 1985

Related U.S. Application Data

[62] Division of Ser. No. 612,032, May 18, 1984, Pat. No. 4,565,001.

[51] Int. Cl.[4] ..... H01R 13/28

[52] U.S. Cl. ..... 339/217 S; 339/48

[58] Field of Search ..... 339/48, 49 B, 217 S

[56] References Cited

U.S. PATENT DOCUMENTS 2,891,103 6/1959 Swengel ..... 339/217 S 2,938,190 5/1960 Krekbiel ..... 339/217 S

*Primary Examiner*—Joseph H. McGlynn

*Attorney, Agent, or Firm*—Pearne, Gordon, Sessions, Mc Coy, Granger & Tilberry

[57] ABSTRACT

Crimp connecting terminals to insulated wires either with or without prior removal as by stripping of the insulation from the end portion of those wires is disclosed herein. The terminals are particularly suited for use in multiconductor connector assemblies and may be selectively treated to impart enhanced resilience to the connection forming portion of the terminal while maintaining the crimp connecting end thereof more malleable for better crimp electrical connection to the wires.

A terminal arrangement for securing contacts within a supporting body.

6 Claims, 22 Drawing Figures

CRIMP CONNECT TERMINALS

SUMMARY OF THE INVENTION

This application is a divisional of parent application Ser. No. 612,032, filed May 18, 1984, now U.S. Pat. No. 4,565,001.

The present invention relates generally to terminals for connector assemblies and more particularly to terminals of the crimp-on type for use in a multiconductor connector assembly.

In my U.S. Pat. No. 3,497,866 granted Feb. 24, 1970, there is disclosed several variations on multiconductor connector assemblies of the type having a plurality of terminals in each of a plug and receptacle with the terminals having first end portions for slidingly forming connections between respective terminal pairs when the plug and receptacle are mated and second end portions connected to respective wires. In this patented arrangement, connection between the individual lead wires and the corresponding terminals is by conventional soldering techniques. Electrical connectors as disclosed in my prior patent are ideally suited for microelectronics equipment applications; however, the individual soldering of leads to terminals is a time consuming and costly process, the elimination of which would be highly desirable.

Among the several objects of the present invention, it may be noted the provision of improvements in the process of crimp connecting terminals to lead wires; the provision of improvements in the technique of fabricating terminals for crimp connection to lead wires; the provision of overall improvements in connectors of the type disclosed in my aforesaid mentioned patent; the provision of a crimp connection between a terminal and a lead wire of enhanced mechanical strength, good electrical connection, and not requiring stripping of insulation from the wire prior to the crimping operation; and provision of an elongated terminal for crimp connection to an associated insulated lead wire having enhanced resilience in one region while being more malleable in another region.

These as well as other objects and advantageous features of the present invention will be in part apparent and in part pointed out hereinafter.

In general, an improved terminal has near its crimp connection end a pair of laterally opposed wrap tabs for encircling and gripping a wire, a pair of opposed serrated crimping tabs for engaging a conductive portion of the wire establishing electrical connection between the wire and the terminal, and a pair of opposed locking tabs for preventing longitudinal movement of the terminal relative to a connector assembly. One or more staggered pointed projections may be provided in the crimping area for puncturing wire insulation and contacting the conductive portion thereof.

Also, in general and in one form of the invention, a plurality of terminals are provided from an elongated strip of terminal stock material and connected to respective insulated lead wires preparatory to disposing the terminals in a multiconductor connector assembly by first blank forming the terminal profiles or silhouettes in the stock material without severing individual terminals from the strip and thereafter shaping the crimp connection end portions of those terminals to a "U" configuration to receive lead wires whereupon the respective lead wires are crimp connected to the terminals and then the interconnected terminals and wires are separated from the strip and remaining terminals. Selective heat treating of the strip to provide enhanced resilience to one terminal end while maintaining the other terminal end more malleable for crimp connecting purposes may be employed.

Further, an arrangement is provided for additionally securing terminals against longitudinal movement the plastic body within which they are mounted. This is an improvement over the designs disclosed in U.S. Pat. No. 3,497,866.

BRIEF DESCRIPTION OF THE DRAWINGS

Corresponding reference characters indicate corresponding parts throughout the several views of the drawings.

Figure 1:
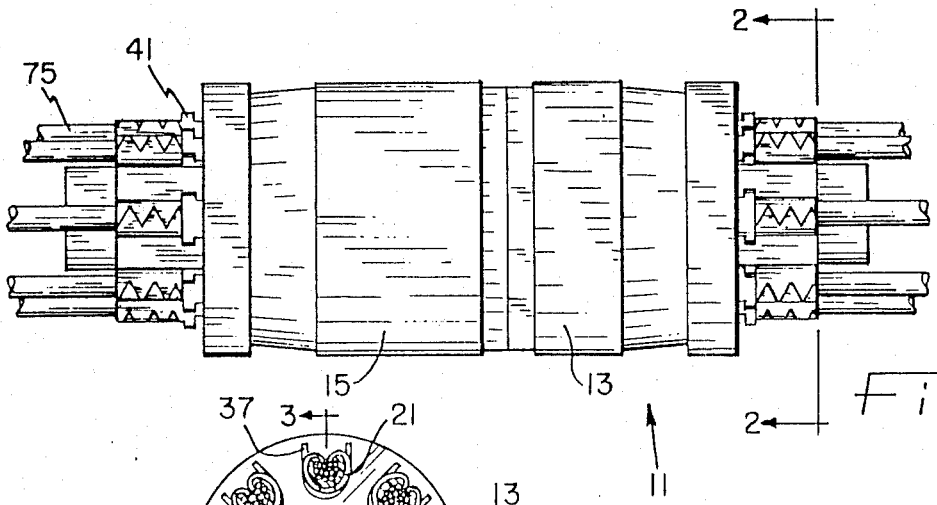
FIG. 1 is a side elevation view of a multiconductor connector assembly embodying the present invention.
Figure 2:
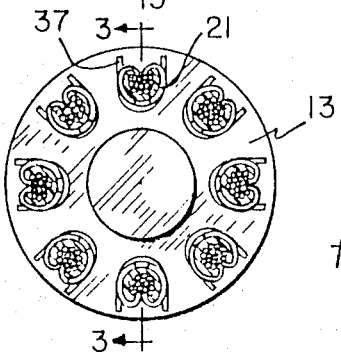
FIG. 2 is a right end view in cross-section along line 2—2 of the connector assembly of FIG. 1.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring first primarily to FIGS. 1 through 4, there is illustrated a multiconductor connector assembly of the type generally illustrated in my aforementioned U.S. Pat. No. 3,497,866 and differing from my patented device only as hereinafter noted. Hence, reference may be had to my prior patent for details not herein recited. Briefly, such a multiconductor connector assembly 11 comprises a mateable plug 13 and a receptacle 15 of molded insulating material and each supporting a plurality of terminals with eight (8) such terminals illustrated in each of the plug and receptacle of FIGS. 1 through 4 while connectors of eight (8) and of twenty (20) pins or terminals are illustrated in my aforementioned patent.

Plug protrusion 17 mates with a receptacle cavity 19 with both the protrusion and cavity being generally cylindrical but with each including a flattened face to ensure proper alignment of the plug and receptacle. When the plug and receptacle are mated, the respective terminals slidingly engage one another to form the individual connections as best seen in FIG. 3.

Figure 3:
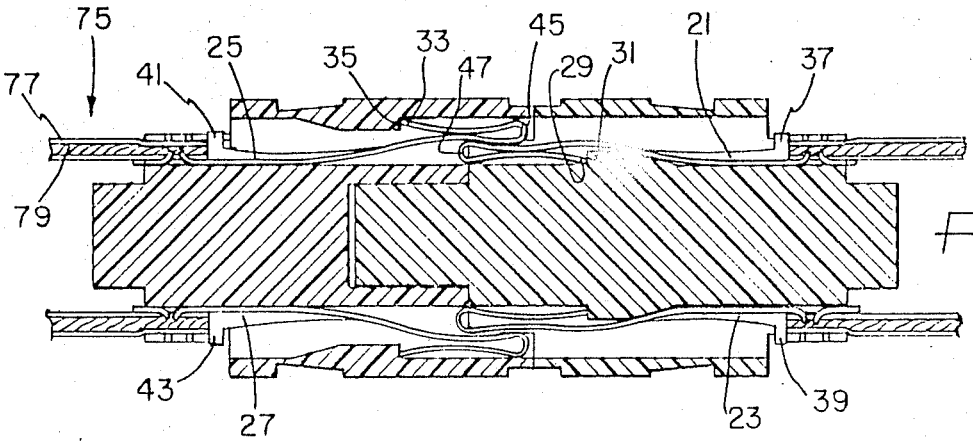
FIG. 3 is a view in cross section along the lines 3—3 of FIG. 2.
Figure 4:
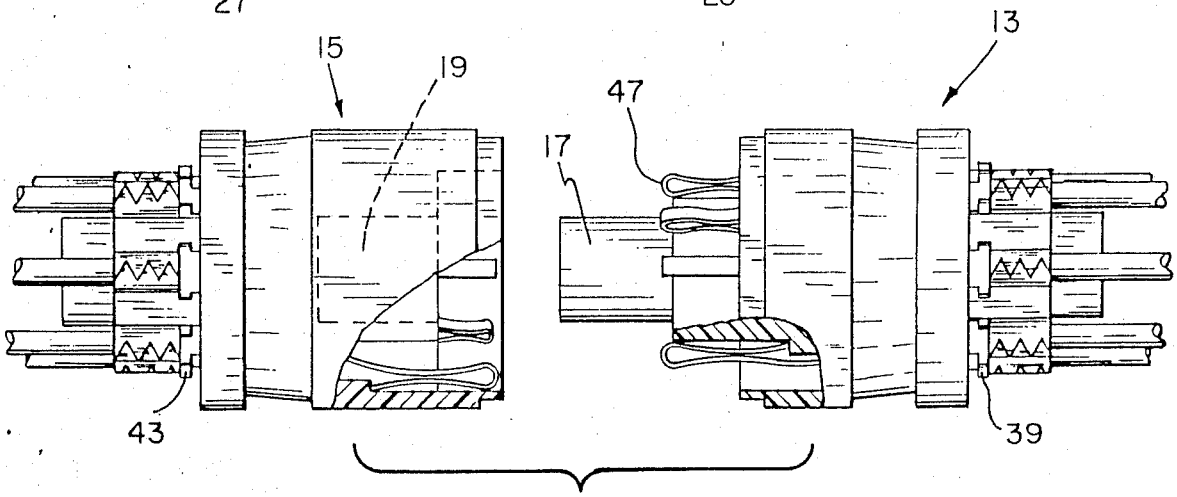
FIG. 4 is a view similar to FIG. 3 but illustrating the plug and receptacle of the connector assembly separated from one another.

In FIG. 3, the terminals such as 21 and 23 associated with plug 13 are all substantially alike and differ only slightly from the terminals such as 25 and 27 associated with receptacle 15. Terminals such as 21 and 23 may be referred to as male terminals while terminals such as 25 and 27 are referred to as female terminals. The primary difference between these two types of terminals is that the free end such as 29 of terminals 21 engages a ledge 31 within the plug 13 which ledge is radially inwardly of the terminal location whereas terminal 25 has a free end 33 which engages a ledge 35 radially outwardly of the terminal in the socket 15. Either type may be formed from the same blank configuration by different forming of the blank. The terminals typically have the lead wires attached thereto and are then positioned in the plug and receptacle by sliding the terminals from the outer ends of plug and receptacle until the free ends such as 29 and 33 snap into position against the ledges such as 31 and 35. The engagement of these free ends and ledges prevents the terminals from being pulled outwardly from the connector assembly while further axial movement in the opposite direction is prevented by tabs such as 37, 39, 41 and 43 to be described in greater detail subsequently. In my prior patented arrangement, the tabs such as 37, 39, 41 and 43 were not present, however, their general function of limiting axial movement of the terminals was provided by a generally "U" shaped trough which also formed the region for soldering connection between the terminals and the respective lead wires. As noted earlier, this soldering which could be performed after assembly of the terminals; interconnection between the lead wires and terminals into the plug and socket, but preferably was performed prior to such assembly, is a costly and time consuming operation which is eliminated by the present invention.

Figure 7:
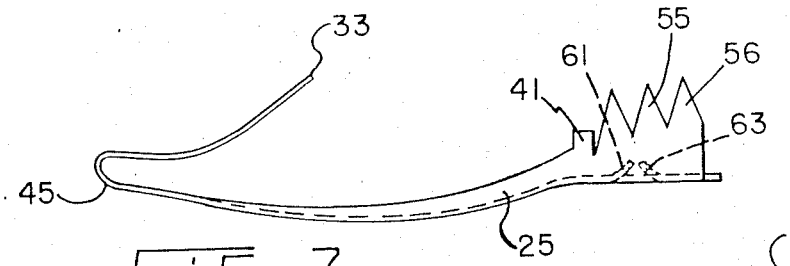
FIG. 7 is a side elevation view of the crimp terminal of FIG. 6 formed preparatory to receiving a lead wire and placement in a plug.

Comparing FIGS. 3, 7 and 9, it will be noted that the male terminals illustrated in FIG. 9 and the female terminal illustrated in FIG. 7, differ from one another primarily in the direction in which the sliding connection forming end portions 45 and 47 are bent with those terminals being otherwise similar and hence forth only an exemplary female terminal 25 and its technique of fabrication will be described.

Figure 5:
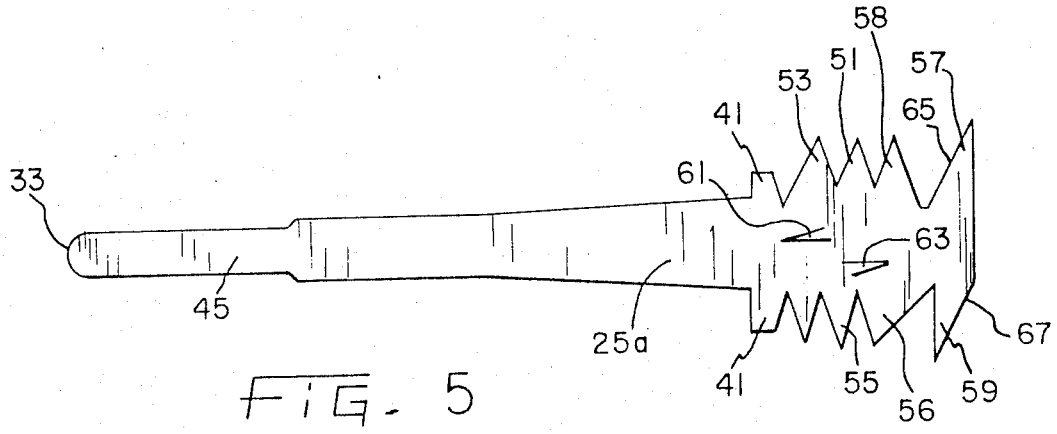
FIG. 5 is a plan view of an unformed crimp terminal according to the present invention.
Figure 6:
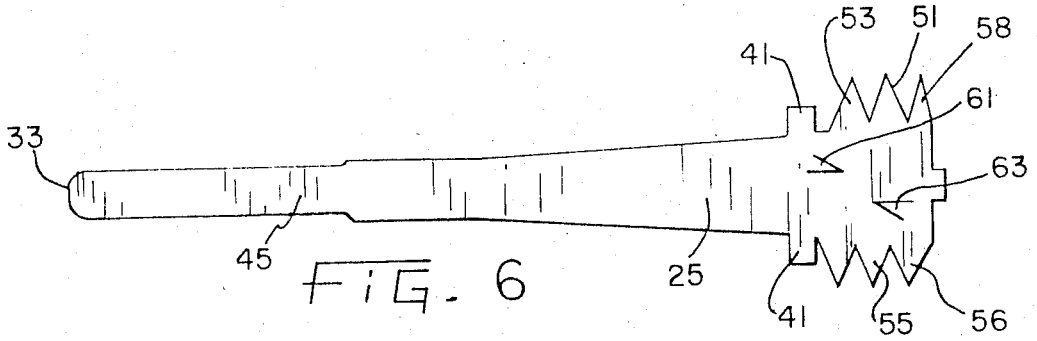
FIG. 6 is a plan view similar to FIG. 5 but illustrating one modification of the crimp terminal.

Referring now to FIG. 6, exemplary terminal 25 is blanked as a punching or shearing operation from an elongated strip of terminal stock material 49 (FIG. 10) so as to have near its second or wire lead connection end portion the pair of laterally opposed locking tabs 41 which prevent longitudinal movement of the terminal relative the connector assembly as well as a pair of opposed serrated crimping tabs including projections such as 51, 53, 55, 56, and 58 with these serrated crimping tabs intended for establishing electrical connection between the wire and terminal by engaging a conductive portion of the wire. Optionally, a pair of laterally opposed wrap tabs 57 and 59 for encircling and gripping an associated wire may also be formed near the second end as illustrated in FIG. 5. A pair of staggered pointed projections 61 and 63 for puncturing wire insulation and contacting the conductive portion of a wire may also be formed in the second end during the blank forming of the terminal silhouette or profile. It will be noted that the opposed serrations as illustrated by the projections such as 51, 53 and 55 are relatively staggered. This allows some interleving of the crimping tab as it is formed about a wire. It will also be noted that the blank forming of terminal 25*a* of FIG. 5 includes shearing material from laterally opposed edges 65 and 67 of the wrap tabs at an oblique angle to the general direction of elongation of terminal 25*a* with those two laterally outermost edges 65 and 67 extending generally parallel to one another so that, when the wrap tab is crimped about an insulated portion of a lead wire, those two edges are juxtaposed by the crimping operation. This oblique outermost edge allows some latitude in the range of wire sizes to be gripped. Other than the presence of the wrap tabs 57 and 59, the terminals 25 of FIG. 6 and 25*a* of FIG. 5 are identical and like reference numerals are used throughout those two drawing views.

Figure 8:
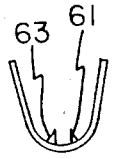
FIG. 8 is an end view of the terminal of FIG. 7.
Figure 10:
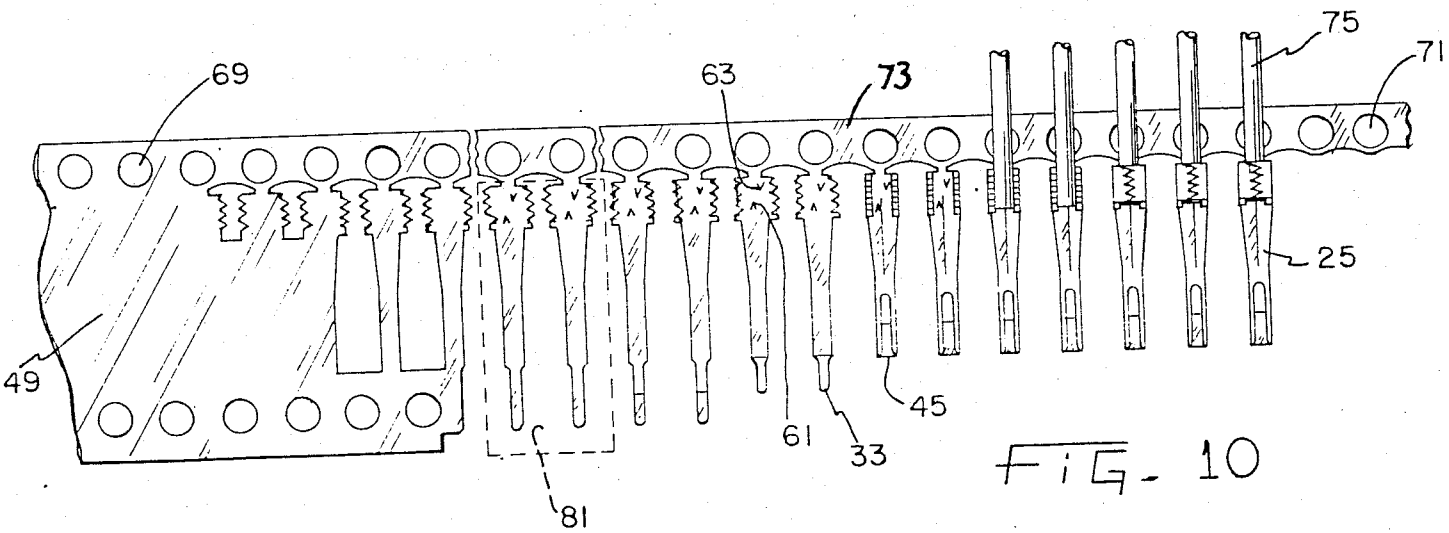
FIG. 10 illustrates the sequential blank forming of the terminal silhouettes beginning with a strip of terminal stock material and ending with a formed terminal and lead wire crimped thereto but still connected to the strip of material.

Referring now primarily to FIG. 10, an elongated strip 49 of, for example, beryllium copper contact material of about 0.005 inch thickness having strip feedholes such as 69 and 71 is passed through a sequence of blanking or shearing, and forming dies to first generate the terminal silhouettes or profiles as illustrated in FIGS. 5 and 6 and to thereafter provide the required bends for the first or contacting making ends such as 45 and the general "U" shape configuration as illustrated in FIG. 8 to the crimping end of the terminal for subsequently receiving a lead wire. Desirably, the entire process illustrated in FIG. 10 may be accomplished while not severing the individual terminals from the strip so that the strip edge 73 remains attached to each of the individual terminals until lead wires such as 75 are crimped to the individual terminals and thereafter a simple bending motion between the strip edge 73 and the individual terminal frees that terminal from edge 73. In the blank forming operation, the individual terminals are formed with their respective directions of elongation traverse to the elongation of the strip and the perforation forming projections 61 and 63 are formed early in the process and preferably prior to shaping the terminal crimp end to the configuration illustrated in FIG. 8.

Figure 13:
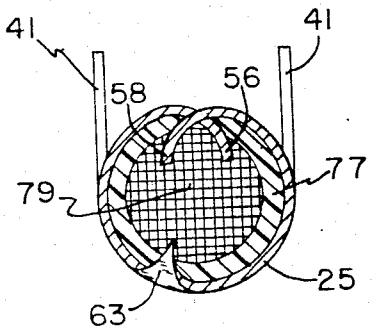
FIG. 13 is a view in cross-section along lines 13—13 of FIG. 12.
Figure 12:
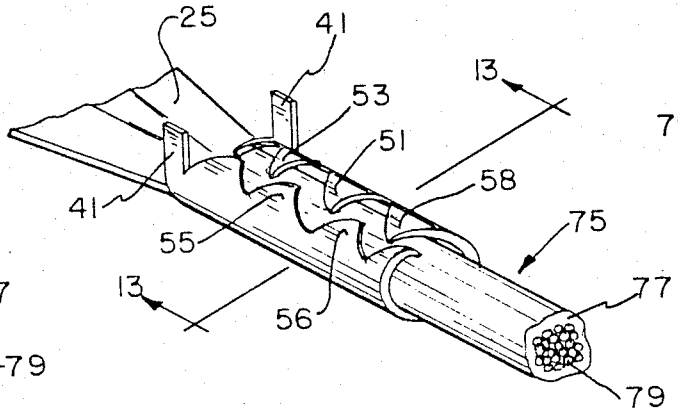
FIGS. 11 and 12 illustrate the sequential forming of the terminal end about an insulated lead wire.
Figure 11:
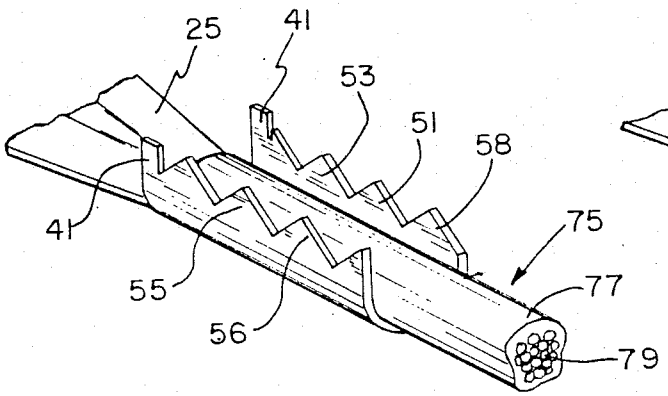

The crimping attachment of a terminal to a lead wire is best seen in FIGS. 11–13. The crimping may be of the "D" type or the "B" type for either the wrap tab or the crimp tab but, of course, the locking tabs 41 are not crimped but rather remain in the position illustrated in FIG. 11 to prevent longitudinal movement of the terminal in the connector assembly except as required for unlocking terminals. Crimping may be to either insulated wire which has not had the insulation stripped therefrom for the connection in which case the projections 61 and 63 punch through that insulation making good contact with the conductors in the wire and additionally and in particular if a "B" type crimp is employed, the serrated edges and their projections 51, 53 and 55 also pierce through the insulation jacket 77 and into a conductor within the wire, or crimping may be to a previously striped wire end. The same terminal is suitable for either type crimping operation. The conductor itself may, of course, be of the stranded, wrapped or solid variety as desired with a stranded conductor 79 being illustrated.

To achieve a good crimp connection to lead wire 75, it is desirable that the deformation of the terminal end being crimped to the wire be substantially plastic in nature with little or no resilience to the serrated crimping tabs or, if present, the locking tabs 57 and 59. Such resilience would be deleterious to the crimp connection manifesting itself as some withdrawal or loosening of the crimp tab from about the wire. On the other hand, the remaining portion of the terminal should possess some resilience since some terminal deformation occurs each time the plug and socket are mated or separated. Selective treatment of the terminals by a precipitation hardening technique may be employed to impart a resilience to the terminal first end portions which cooperate during mating and unplugging of the connector while maintaining the second end portions, that is those portions involved in the crimp connecting process, more malleable or ductile. One technique for accomplishing this selective treatment of the terminal is to merge the blank formed strip of terminal silhouettes which are still connected to the edge strip 73 with a strip of metallic foil 81 as illustrated in FIG. 10. The foil strip 81 is of width sufficient to cover the blank formed terminals while leaving the edge 73 exposed. The two merged strips may be wound together on a spindle and then heated in an oxidation preventing atmosphere and subsequently cooled with the coil acting as a heat sink imparting a differential heat treating effect to the two ends of the terminals.

At the time the invention of U.S. Pat. No. 3,497,866 was made, thermo-setting molding material was used for molding the terminal-supporting bodies 13 and 15, these being referred to hereinabove as the plug 13 and the receptacle 15. Since that time, a number of thermal plastic molding materials have been developed which may be used in injection-type molding presses for molding such bodies 13 and 15, this material being substantially less expensive than, thermo-setting plastics.

Use of the thermal plastic materials introduces problems not earlier contemplated, one of these being caused by the shorter molding time in the process of injection molding. It is not unusual that the molding time, i.e., the time the plastic part is in the molding die, is shorter than the required time for the plastic to complete its cure, with the consequence that the plastic material migrates thereby altering shapes and dimensions of the molded part. Shrinkage can result that can vary from ten thousandths (0.010) to as much as sixty thousandths (0.060) of an inch per inch. By comparison, thermo-setting plastics typically shrink from about three thousandths (0.003) to about six thousandths (0.006) of an inch per inch.

With respect to the connectors of prior U.S. Pat. No. 3,497,866, the distal end of the terminal tab portion engaged a radial shoulder or ledge like that indicated by the numerals 31 and 35 herein for locking the terminal against accidental removal from the supporting body 13, 15. When the supporting body 13, 15 is, however, molded of a thermal plastic material, the changes in dimensions and shapes as described in the foregoing can result in the shoulders 31 and 35 becoming radiused or otherwise changing shape such that the distal end of the tab portion of the terminal which was engageable therewith will not lock properly such that when a longitudinal pulling force is applied to the terminal, the tab end slides up over the shoulder thereby releasing the terminal. This, of course, cannot be tolerated in an connector arrangement wherein terminals are exposed to such a pulling force.

According to the present embodiment, this problem has been solved. Reference may now be had to FIGS. 3*a*, 3*b*, 4*b*, 5*a*, 6*a*, 7*a*, 9*a*, and 9*b*. These figures correspond to the figures not having the suffix letters and serve to illustrate the change in design which constitutes the further improvement being claimed hereinafter.

Figure 5A:
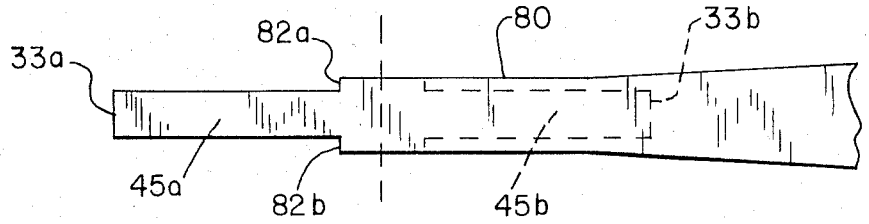
FIG. 5*a* is a fragmentary view like that of FIG. 5 showing the improved terminal configuration.
Figure 6A:
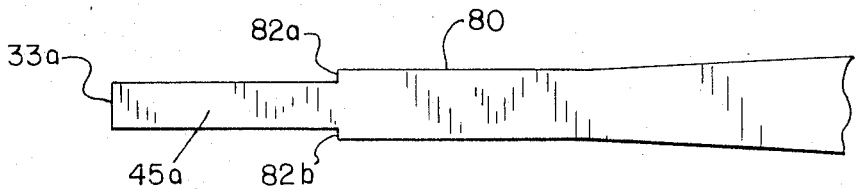
FIG. 6*a* is a fragmentary view like that of FIG. 6 but showing the improved design.
Figure 7A:
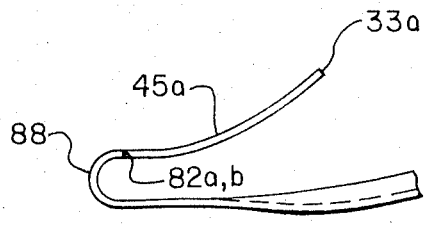
FIG. 7*a* is a fragmentary view of the terminal of FIG. 7 but modified in accordance with the improvement.

Referring first to FIGS. 5*a* and 6*a*, the terminal blanks are shown as being formed with a straight end edge 33*a* which extends normal to the longitudinal axis of the terminal. The shank portion 80 of the terminal is shown as being slightly longer than that shown in FIGS. 5 and 6 and to be squared off where it joins the tab portion 45*a* to define two straight, laterally extending edge portions 82*a* and 82*b*. Typically, the shank portion 80 has a width of about fifty thousandths (0.050) inches whereas the tab portion 45*a* is forty thousandths (0.040) inches wide with the two edges 82*a* and 82*b* being in line and straight. These edges 82*a* and 82*b* form sharp corners where they join both the shank portion 80 and the tab portion 45*a*. The distal end edge 33*a* also has sharp, right angle corners.

Figure 9:
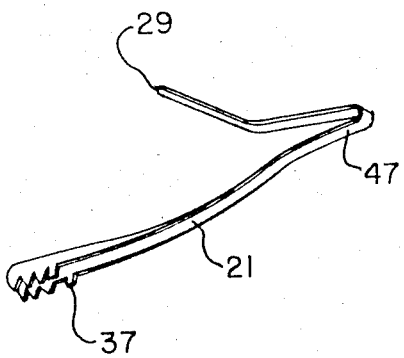
FIG. 9 is a perspective view of a terminal similar to FIG. 7 but designed to be disposed in the socket of FIGS. 1 through 4.
Figure 9B:
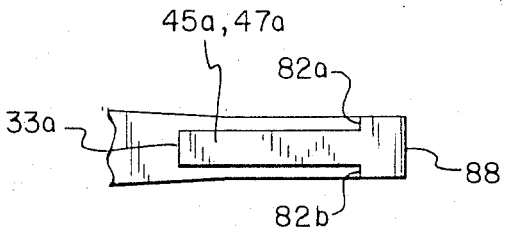
FIG. 9*b* is a fragmentary, bottom plan view of the detent portion of the terminal showing the disparity in width dimensions of the contact and tab portions and also showing the laterally extending edges formed where the tab portion joins the U-shaped bend.
Figure 9A:
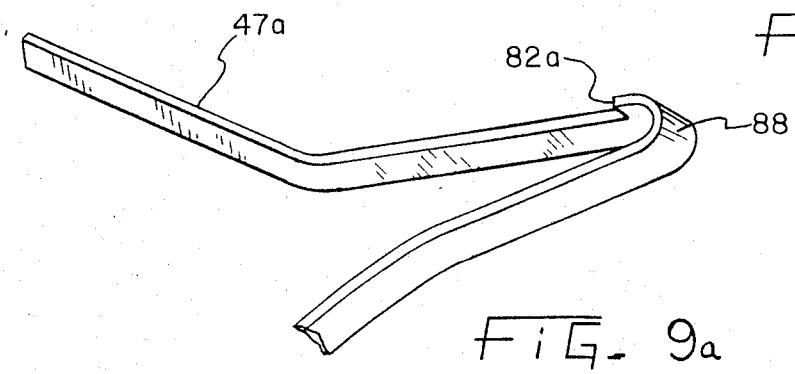
FIG. 9*a* is a fragmentary perspective view like that of FIG. 9 of a terminal similar to FIGS. 7 and 7*a* but designed in accordance with the improvement of this invention.

When the blank of FIGS. 5*a*, 6*a* is bent into the shape of FIG. 9*a*, otherwise the same as FIG. 9, the edge portions 82*a* and 82*b* are located as shown, on the underlying tab portion 47*a* just beyond the U-shaped bend 88. This is otherwise shown in enlarged form in FIG. 9*b*.

Figure 3A:
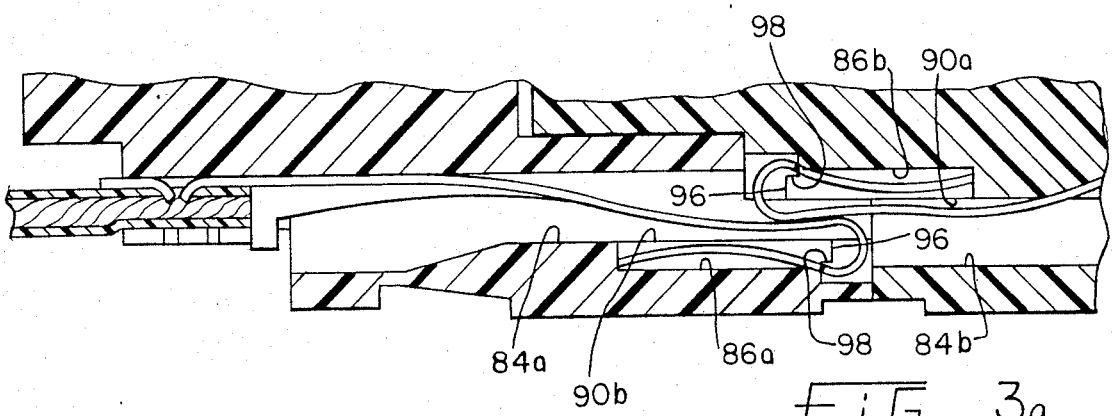
FIG. 3*a* is a fragmentary enlargement of a portion of FIG. 3 but showing the improvement for further securing the terminals against longitudinal movement within the supporting body.
Figure 3B:
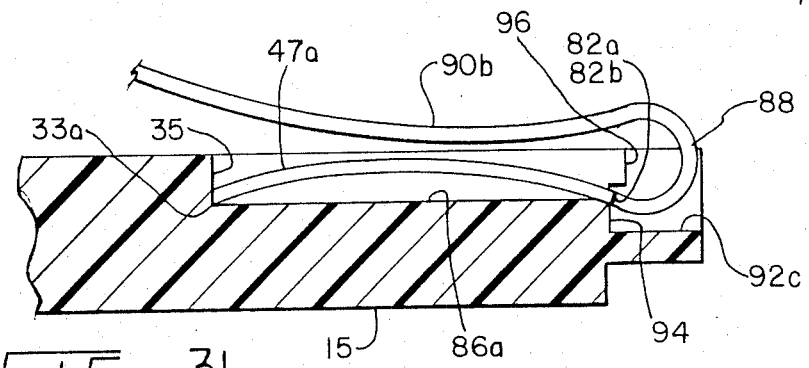
FIG. 3*b* is another additionally enlarged fragmentary section of a portion of FIG. 3*a* showing in detail the undercut in the supporting body located in registry with the U-shaped bend of the terminal.
Figure 4A:
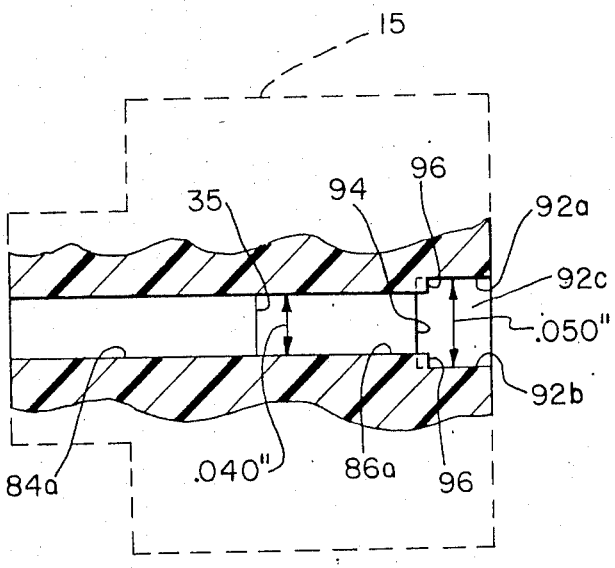
FIG. 4*a* is a fragmentary, longitudinally sectioned portion of the female connector of FIG. 4 showing the enlarged end portion of the groove which provides a shoulder for engagement by straight edges disposed on the underside of the U-shaped bend shown in FIG. 3*b;*
Figure 4B:
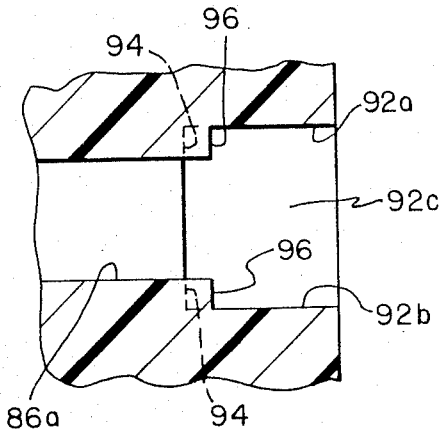
FIG. 4*b* is a view similar to FIG. 4*a* but enlarged to show in more detail the locking recess in the groove adapted to be engaged by said straight edges.

The bodies 13 and 15 are formed with a plurality of circularly arranged passageways 84*a* and 84*b*, each receiving a respective terminal as clearly disclosed in prior U.S. Pat. No. 3,497,866. The passageways 84*a* and 84*b* have grooves 86*a* and 86*b* extending longitudinally therefrom in the surfaces 90*a* and 90*b* of the plastic bodies 13 and 15, respectively. The outer extremities of the grooves 86*a* and 86*b*, as otherwise illustrated for the groove 86*a* in FIGS. 3*b* and 4*b*, are enlarged to provide opposite groove walls 92*a* and 92*b* and a bottom 92*c*. This enlargement is formed with axially spaced radial edges or shoulders 94 and 96 that lie in parallel planes normal to the axis of groove 86*a* thereby to form an overhanging, square-cornered ledge 98 as shown in FIGS. 3*a* and 3*b*. Typically, the passageways 86*a* and 86*b* are circular in cross section and the grooves 86*a* and 86*b* are semi-circular. The enlargement 92*a*, 92*b*, 92*c* preferably is also semi-circular in cross-section. The shoulder 94 may be U-shaped with the inner opening coextensive with the groove 86*a*. In any event, the edges 82*a*, 82*b* and shoulders 94 are dimensioned so as to be abuttably engaged. However, the passageways and grooves may be of orthogonal cross-section or any other shape as is compatible with the terminals fitted thereinto.

Typically, the cross-sectional diameter of the groove 86*a* is forty thousandths (0.040) inches while the diameter of the enlargement 92*a*, 92*b* and 92*c* is fifty thousandths (0.050) inches.

The terminals are so dimensioned that when they are properly fitted into the respective passageways and grooves, they will lock into position as shown in the drawings and more particularly as shown in FIGS. 3*a* and 3*b*. The distal end 33*a* and the sharp corners of each terminal engages and lock against the respective ledge 35 even though it may be slightly rounded, the sharp corners anchoring against slippage. The lateral edges 82*a* and 82*b* simultaneously engage the radial shoulders 94 under the ledges 98 on the opposite sides of the groove 86*a*. The terminal is thus positively locked against movement toward the left or upward as viewed in FIG. 3*b*. The enlargement 92*a*, 92*b*, 92*c* serves yet another purpose as may be understood by reference to FIGS. 3*a* and 3*b*. It will be noted that the U-shaped bend 88 is in registry with this enlargement and that a clearance is normally provided between this bend 88 and the bottom 92*c* of the enlargement. Thus, when the male and female parts of the connector assembly are initially engaged such that the U-shaped bends 88 of both the male and female terminals initially engage, each of these bends 88 will be flexed radially toward the respective bottoms 92*c* thereby facilitating further sliding movement until the male and female parts 13 and 15 are fully engaged as shown in FIG. 3. Additionally, edges 82*a* and 82*b* are nestled into the molded recess 98 as shown in FIGS. 3*a* and 3*b* when the male and female parts are mated. When the parts are disassembled, all terminals may be moved forwardly from the wire—lead ends thereby unlocking the edges 82*a* and 82*b* from the recess 98 which will permit removal of the terminal by inserting the terminal removal tool disclosed in U.S. Pat. No. 3,497,866, FIG. 12. This is advantageous because the end portions 88 are not distorted during the initial stages of engagement and the final stages of disengagement. This results in greater wear life in the terminals.

These improvements are especially important in the respect that as the art moves further into miniaturized and micro-miniaturizd components, "single source" tooling which accommodates both thermal-plastic and thermo-setting plastic materials may be used interchangeably. While this leads to reduced costs, as has already been explained, functional advantages are further realized in the additional terminal retention force as well as increasing durability of the terminals themselves.

While there have been described above the principles of this invention in connection with specific apparatus, it is to be clearly understood that this description is made only by way of example and not as a limitation to the scope of the invention.

What is claimed is:

1. For use in an electrical connector, an elongated metallic contact member having length, width and thickness dimensions, said contact member including terminal and detent portions on the opposite ends thereof, an elongated shank portion interconnecting said terminal and detent portions, said detent portion including an elongated contact portion and an elongated tab portion disposed adjacent to each other and extending in longitudinal juxtaposition, adjacent ends of said contact and tab portions being joined in a substantially U-shaped reflex bend, the distal end of said tab portion having a straight edge substantially normal to the longitudinal axis of said tab portion, said contact and tab portions being resiliently flexible and movable toward and away from each other, said terminal portion being a longitudinal extension of said shank portion, said terminal portion having two side flanges extending transversely beyond the shank portion to thereby serve as an abutment, said contact portion and said U-shaped bend being wider than said tab portion and joining the extremity of said U-shaped bend in laterally opposite edges which extend substantially perpendicular to the longitudinal axis of said tab portion thereby providing locking edges at said adjacent end of said tab portion.

2. The contact member of claim 1 including a rigid body of insulating material, said body having opposite ends and at least one substantially straight passageway extending therethrough between said ends, one of said ends having a surface extending substantially parallel to said passageway, said surface having a groove which is a longitudinal extension of said passageway, said passageway receiving said contact member for sliding movement longitudinally but holding said contact member against lateral movement, said detent portion being received and held against lateral movement by said groove, locking means for holding said contact member against longitudinal movement in its passageway; the contact surface of said detent portion projecting radially above said surface, and said locking means including engaging parts on said body and said contact member for preventing longitudinal movement of said contact member in one direction, abutment means on said body engageable by said opposite end of said tab portions and said locking edges for preventing longitudinal movement of said contact members in the opposite direction.

3. The combination of claim 2 wherein said abutment means includes a radial shoulder in said groove spaced inwardly from the outer end and engageable by the straight end edges of said tab portion.

4. The combination of claim 3 wherein said abutment means includes an enlarged outer end portion of said groove having a first laterally extending shoulder and a second outwardly extending shoulder which together form a square cornered over-hanging ledge joining said groove, said ledge being engageable by said locking edges.

5. The combination of claim 3 wherein said abutment means includes an enlarged outer end portion of said groove having a laterally extending shoulder and a second outwardly where it joins said groove and which is engageable by said locking edges.

6. The combination of claim 5 wherein said enlarged outer end portion is in registry with the U-shaped bend of said detent portion and has a bottom normally spaced therefrom whereby said U-shaped bend may flex theretoward.

* * * * *